United States Patent [19]

McKnight

[11] Patent Number: 4,534,738

[45] Date of Patent: Aug. 13, 1985

[54] TUG TYPE VESSEL

[76] Inventor: Thomas J. McKnight, New Bern, N.C. 28560

[21] Appl. No.: 356,354

[22] Filed: Mar. 9, 1982

[51] Int. Cl.[3] ..... B63H 5/12; B63B 1/12

[52] U.S. Cl. ..... 440/61; 114/61; 440/53

[58] Field of Search ..... 114/61, 242, 26, 28, 114/29, 32; 440/53, 58, 59, 60, 61

[56] References Cited

U.S. PATENT DOCUMENTS

| | | | |
|---|---|---|---|
| 522,348 | 7/1894 | Martini | 114/61 |
| 944,209 | 12/1909 | Reed | 114/61 |
| 2,794,410 | 6/1957 | Oliver et al. | 440/58 |
| 3,469,558 | 9/1969 | Puretic | 440/53 |
| 3,581,702 | 6/1971 | Moberg | 440/61 |
| 3,750,607 | 8/1973 | Seymour et al. | 114/242 |
| 4,227,480 | 10/1980 | Carras | 114/61 |

FOREIGN PATENT DOCUMENTS

| | | | |
|---|---|---|---|
| 1956976 | 7/1971 | Fed. Rep. of Germany | 440/53 |
| 119933 | 7/1970 | Norway | 114/29 |

*Primary Examiner*—Trygve M. Blix
*Assistant Examiner*—Rodney Corl
*Attorney, Agent, or Firm*—Mills & Coats

[57] ABSTRACT

This invention is a tug type vessel which can be operated in shallow as well as deep water, is relatively powerful compared to its overall length, and is versatile in that additional drive units can be added as required to form an integral propulsion system. This is accomplished through the use of a plurality of floats interconnected with pivotable power units supported therebetween.

6 Claims, 8 Drawing Figures

TUG TYPE VESSEL

FIELD OF INVENTION

This invention relates to propulsion systems and more particularly to marine type propulsion systems of the tug type.

BACKGROUND OF INVENTION

Since the first mechanical propulsion systems were adapted to maritime use, mariners as well as maritime engineers have been concerned with providing the most powerful and yet compact system possible for not only aiding in the maneuvering of relatively large vessels in restricted areas and during special maneuvering such as docking, but also have been used in the marine construction field for maneuvering barges, cranes, dredges and the like during the performance of various construction functions.

The various vessels used in performing these marine tasks have included large propellers driven at a relatively low speed by powerful engines. The more powerful the tug, the larger the engine and thus the larger the boat to house the same. On many occasions, particularly in the marine construction industry, large powerful tugs are required and yet, due to draft limitations, they cannot be practically employed. Further large powerful, shallow draft tugs have not been believed to be practical from either a technical or economic viewpoint.

After much research and study into the above-mentioned problems, the present invention has been developed to provide a powerful, shallow draft tug vessel of relatively short length that is particularly adapted for use on inland waters where varying depths are routinely encountered. This improved tug means further has the capability of allowing additional propulsion units to be added to increase the power of the system without increasing its length, draft or ability to maneuver.

The above is accomplished through the use of individual hull type floats or pontoons which are interconnected with the propulsion system pivotably mounted therebetween so that the depth of the propeller, rudders, etc., can be raised and lowered as necessary. Additional floats and propulsion units can be added without increasing the draft of the integrated tug system. Further, hauling for maintenance and/or repairs can be accomplished without removal of the tug from the water and in fact worn or damaged propulsion units can be removed and replaced in their entirety thereby giving the system of the present invention even greater versatility.

In view of the above, it is an object that the present invention to provide a powerful yet compact marine vessel.

Another object of the present invention is to provide a powerful, compact and yet shallow draft marine vessel particularly adapted to tug operations.

Another object of the present invention is to provide a powerful, shallow draft, compact tug type marine vessel wherein the operating depth thereof can be readily varied.

Another object of the present invention is to provide a tug type vessel which can operate in both deep and shallow waters.

Another object of the present invention is to provide a tug type vessel which includes a pivotable propulsion system.

Another object of the present invention is to provide, in a tug type vessel, a propulsion system wherein the underwater portion is readily removable from the water for maintenance and/or repair without dry docking of the vessel.

Another object of the present invention is to provide a tug type vessel wherein additional propulsion systems can be readily added or removed as the situation dictates.

Another object of the present invention is to provide a powerful tug type vessel which is short in length and shallow in draft.

Other objects and advantages of the present invention will become apparent and obvious from a study of the following description and the accompanying drawings which are merely illustrative of such invention.

DETAILED DESCRIPTION OF INVENTION

With further reference to the drawings, the tug type vessel of the present invention, indicated generally at 10, includes a plurality of float means indicated generally at 11 and at least one propulsion unit indicated generally at 12.

Each of the float means includes a plurality of interior frames 13 covered on the sides 14 with a sheet material such as steel. The bottom 15 and the deck 16 are likewise covered to form an enclosed, water tight float means. Although not specifically shown, access hatches can, of course, be provided as deemed necessary through deck 16. Although steel has been indicated as a good exterior covering for frames 13, aluminum or other suitable material can be used as well as fiberglass and other types of plastic. Additionally, these floats could contain fuel tanks as well as being filled with foam type plastic to make them unsinkable relative to the loads carried.

Since boat building details of the type enumerated above are well known to those skilled in the art, further detailed description of the same is not deemed necessary.

Figure 6:
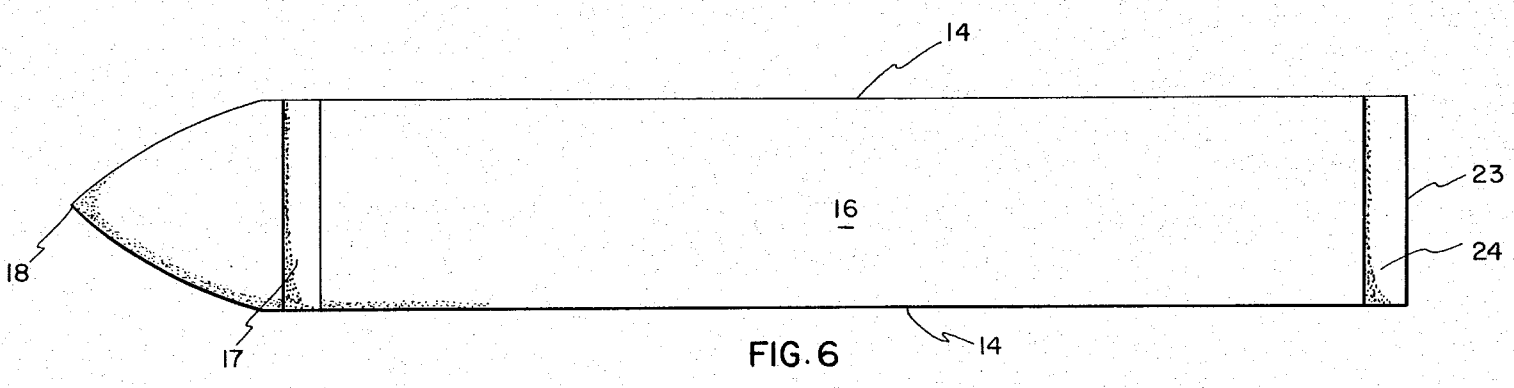
FIG. 6 is a top plan view of a typical float.
Figure 7:
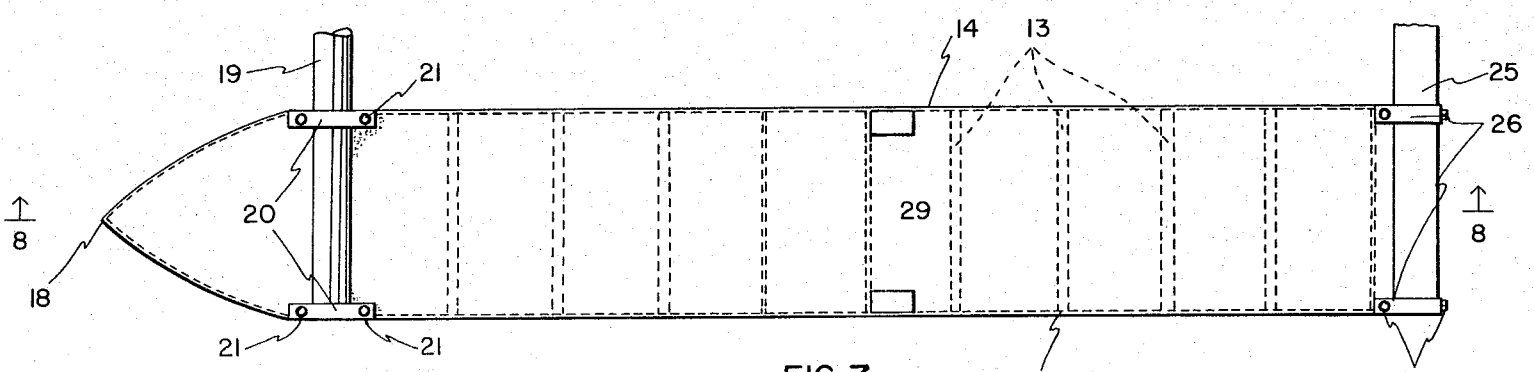
FIG. 7 is a top plan view of a typical float showing details of interior framing and interconnecting members.
Figure 8:
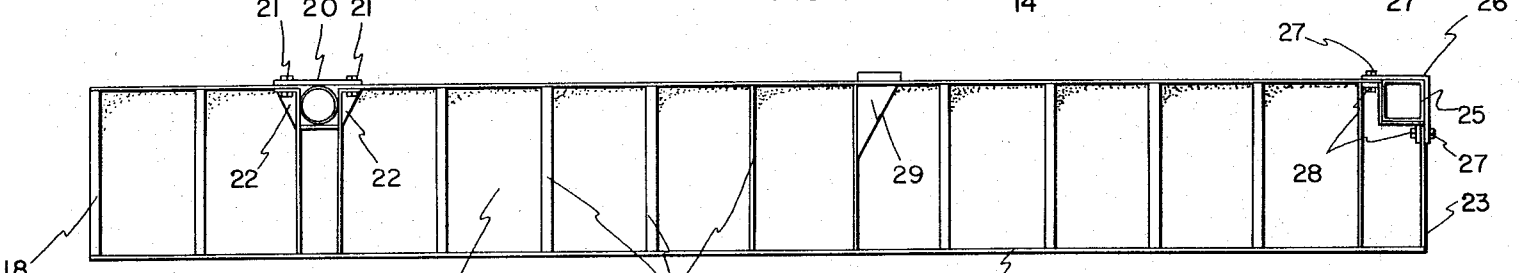
FIG. 8 is a sectional view taken through lines 8—8 of FIG. 7.

In the area adjacent the bow 17 of each of the floats is provided a transverse slot 18 across the deck 16 as can clearly be seen in FIG. 6. This transverse slot is adapted to receive pivot pipe 19 which is held in place by cap plates 20 which are through bolted as indicated at 21 to brackets 22 which are fixed to either side of hull means 11 as can clearly be seen in FIGS. 7 and 8.

In the deck 16 at stern 23 includes a transverse notch 24 which is adapted to receive float interconnecting box beam 25. An L-shaped hold down member 26 is bolted as indicated at 27 to brackets 28 fixed to opposite sides of hull means 11 as again can be seen in FIGS. 7 and 8.

Tilt jack pads 29 are provided midship hull or float means 11 adjacent the sides thereof. The purpose of these tilt jack pads will become obvious from the following description. Each of these pads are firmly secured to the hull 11 and preferably one is provided on either side thereof so that the hull can be used interchangeably on either the port or the starboard side of the propulsion unit 12.

Referring more specifically to the propulsion unit 12 of the present invention, parallelly disposed main frames 30 and 31 are provided and are rigidly interconnected by forward cross member 32, midship cross member 33, and aft cross members 34 and 35. The various cross members can be connected to the main frames by any suitable means such as weldment.

To the forward ends of main frames 30 and 31 are welded or otherwise secured push knee extensions 36 and 37, respectively. Generally uprightly disposed push knees 38 and 39 are fixedly secured at one end to their respective push knee extensions 36 and 37 and are braced back against such extensions at their opposite ends by push knee braces 40 and 41, respectively.

Figure 1:
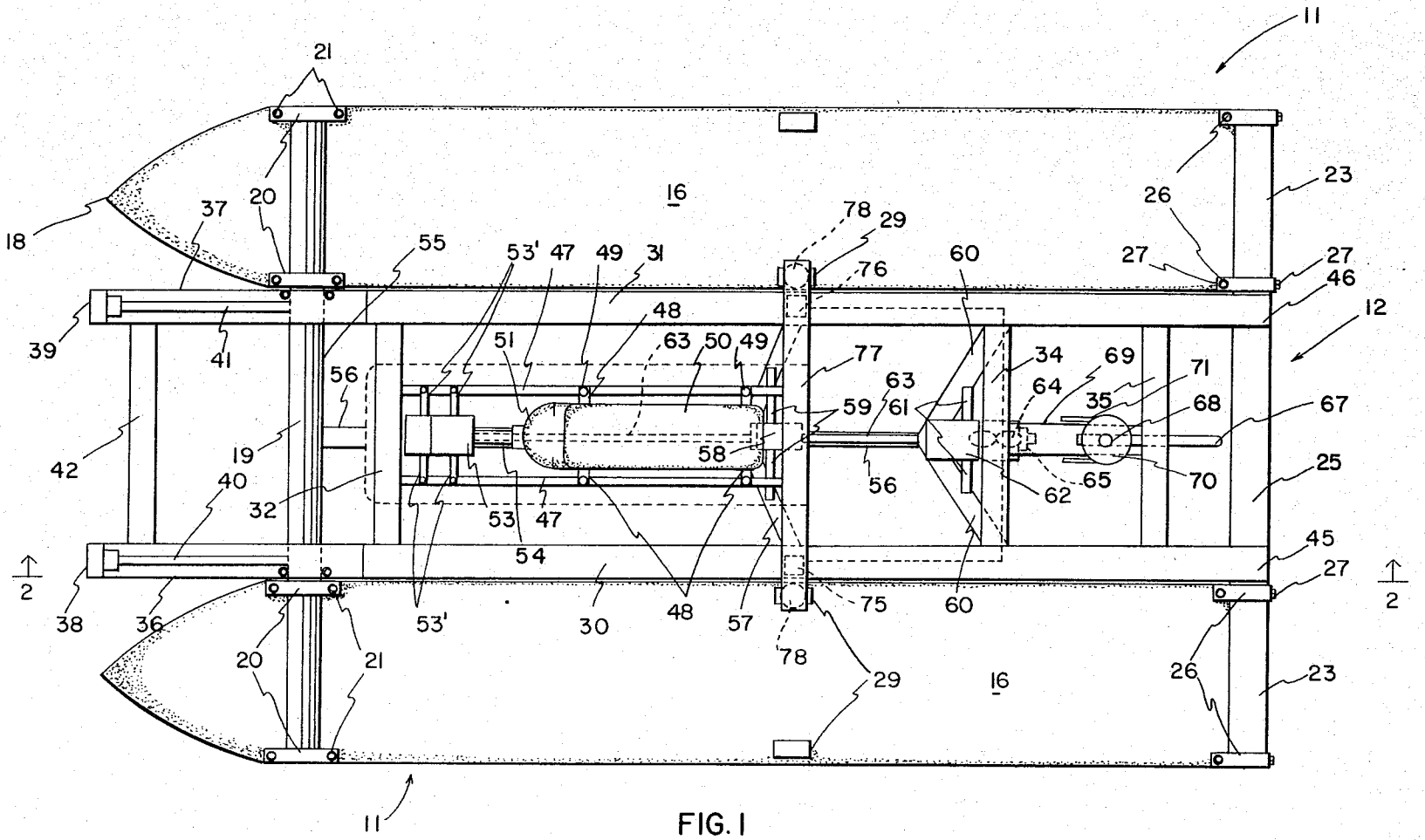
FIG. 1 is a top plan view of the improved tug vessel of the present invention.
Figure 2:
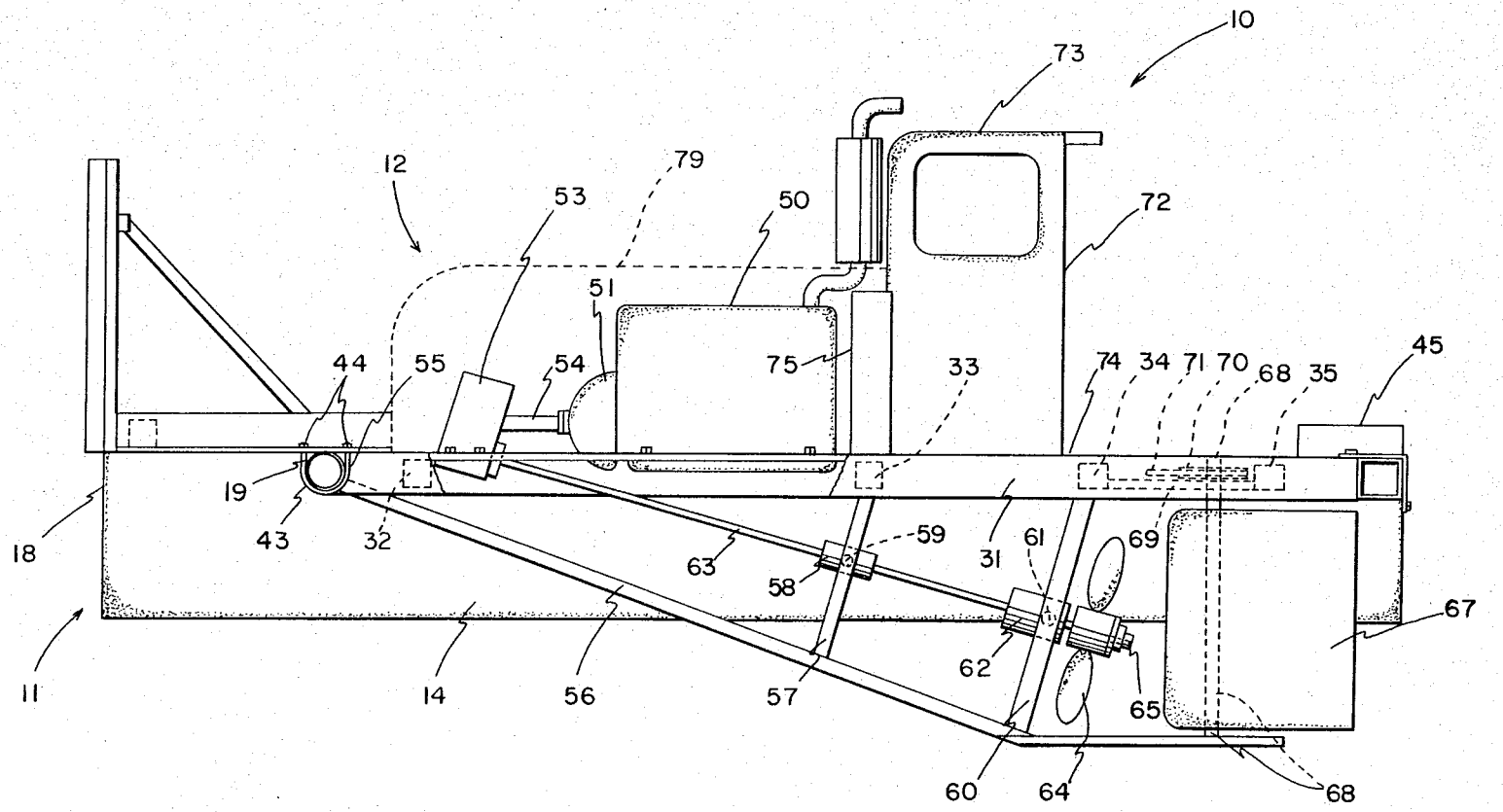
FIG. 2 is a sectional view taken through lines 2—2 of FIG. 1.

A push knee cross member 42 is disposed between and secured to push knees 36 and 37 as can clearly be seen in FIGS. 1 and 2.

Each of the push knees 38 and 39 are padded in the normal manner to prevent damage to the barge, crane, or other vessel being used in conjunction with the tug type vessel of the present invention. Since padding of this type is well known to those skilled in the art, further detailed discussion of the same is not deemed necessary.

U-bolts 43 and their related nuts 44 are used to secure the propulsion unit 12 to pivot pipe 19 as can clearly be seen in FIGS. 1 and 2.

Fixedly secured to the aft end of main frames 30 and 31 are support blocks 45 and 46, respectively. These blocks are adapted to engage and rest on hull interconnecting beam 25 as again can be clearly seen in FIGS. 1 and 2.

Secured to and disposed between forward cross member 32 and midship cross member 33 are engine and drive supports 47. Engine brackets 48 are releasably connected to engine supports 47 by means such as bolts 49 to mount engine 50 and its related transmission 50′ relative to main frames 30 and 31. Likewise drive brackets 51 are releasably secured to engine and drive supports 47 by means such as bolts 52 for mounting V-drive 53.

Since engine 50, transmission 50′, V-drive 53 and their interconnecting drive shafts 54 are all well known to those skilled in the art, further detailed discussion of the details of the same is not deemed necessary.

An end plate 55 is attached to and extends between main frames 30 and 31. Fixedly secured to the central portion of end plate 55 is a keel member 56 which extends downwardly at an angle therefrom. Intermediate V-bracket 57 is secured at its upper ends to frames 30 and 31 and at its lower end to keel member 56. A propeller shaft bearing 58 is mounted between the V-bracket 57 by support members 59 on either side thereof.

The upper ends of aft V-bracket 60 are fixedly secured to main frames 30 and 31 adjacent first aft cross member 34. The lower peak of bracket 60 is fixedly secured to keel 56 with support members 61 extending between the arms of such V-bracket 60 to support propeller shaft bearing 62.

Propeller shaft 63 is operatively connected to V-drive 53 at one end, passes through shaft bearings 58 and 62, and terminates at propeller 64 which is held on such shaft by releasable propeller securing means 65. Since propeller shafts, shaft bearings, propellers, and propeller securing means are all well known to those skilled in the art, further detailed description of these portions of the present invention is not deemed necessary.

A skeg 66 is secured at its forward end to the aft end of keel member 56 and extends aft to a point below rudder 67. This rudder is preferably of the counter-balance type and is mounted on rudder pin 68 which is rotatively secured to skeg 66 at its lower end and extends through rudder mounting bracket 69 at its upper end. This mounting bracket is secured between the two aft cross members 34 and 35 as can clearly be seen in FIGS. 1 and 2.

Fixedly secured to the upper end of rudder mounting rod 68 is steering pulley 70. This steering pulley has a steering cable or chain 71 trained thereabout which leads to the interior 72 of cabin or pilot house 73 and is operatively connected to appropriate controls (not shown) therein. Since remote steering systems of this type as well as hydraulic and similar systems are well known to those skilled in the art, further detailed description of the same is not deemed necessary.

Due to the proximity of the upper portion of rudder mounting rod 68 to deck 74, provision for an emergency tiller to releasably engage such rod can readily be fashioned.

Upright support stanchions 75 and 76 are fixedly secured at their lower ends to main frames 30 and 31, respectively. The upper end of these two stanchions are fixedly secured to opposite ends of lift beam 77 which extends outwardly to a position over the tilt jack pads 29 of the adjacent hulls 11 on either side of the propulsion unit 12.

A suitable tilt means such as hydraulic jacks 78 are fixedly secured to the outer ends of lift beam 77 and releasably disposed on the top of the nearest tilt jack pad 29. Each of these tilt jacks 78 are operatively driven by an appropriate hydraulic systems contained within engine housing 50. Since details of hydraulic systems of this type and the controls used in conjunction therewith are well known to those skilled in the art, further detailed description of the same is not deemed necessary.

A cowl type cover 79 is provided over the mechanical portions of the present invention to protect the same from the elements. This cowl, of course, is secured to the vessel in an appropriate manner.

For a clearer understanding of the present invention, deck 74 is shown as removed in FIG. 1. It is to be understood, however, that such deck covers frames 30 and 31 and all of the open area therebetween.

Inspite of the fact that the tug type vessel of the present invention is a powerful vessel with tremenduous thrust capabilities, when in disassembled form it can readily be transported on highway type vehicles to whatever distant point it is needed.

Figure 4:
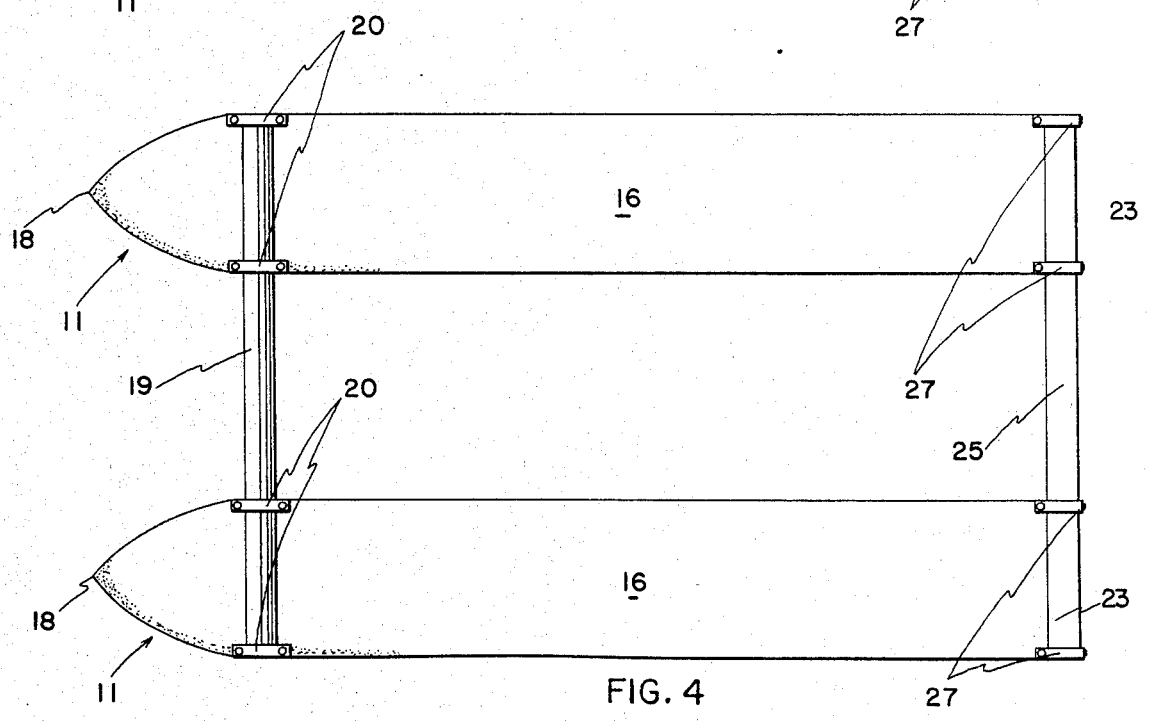
FIG. 4 is a top plan view of the floats used in conjunction with a single propulsion unit.

Once the tug type vessel of the present invention has arrived at its launch location, the pontoons or hull means 11 are placed in the water. Once floated the hulls are placed parallel to each other and pivot pipe 19 is placed in transverse slot or well 17 and is secured in place by cap plates 20 secured by bolts 21. Next the hull interconnecting beam or cross member 25 is placed in the transverse notches 24 of each of the hulls and is secured in place by L-shaped hold down members 26 secured by bolts 27. Thus a catamaran configuration such as that shown in FIG. 4 is provided.

Figure 5:
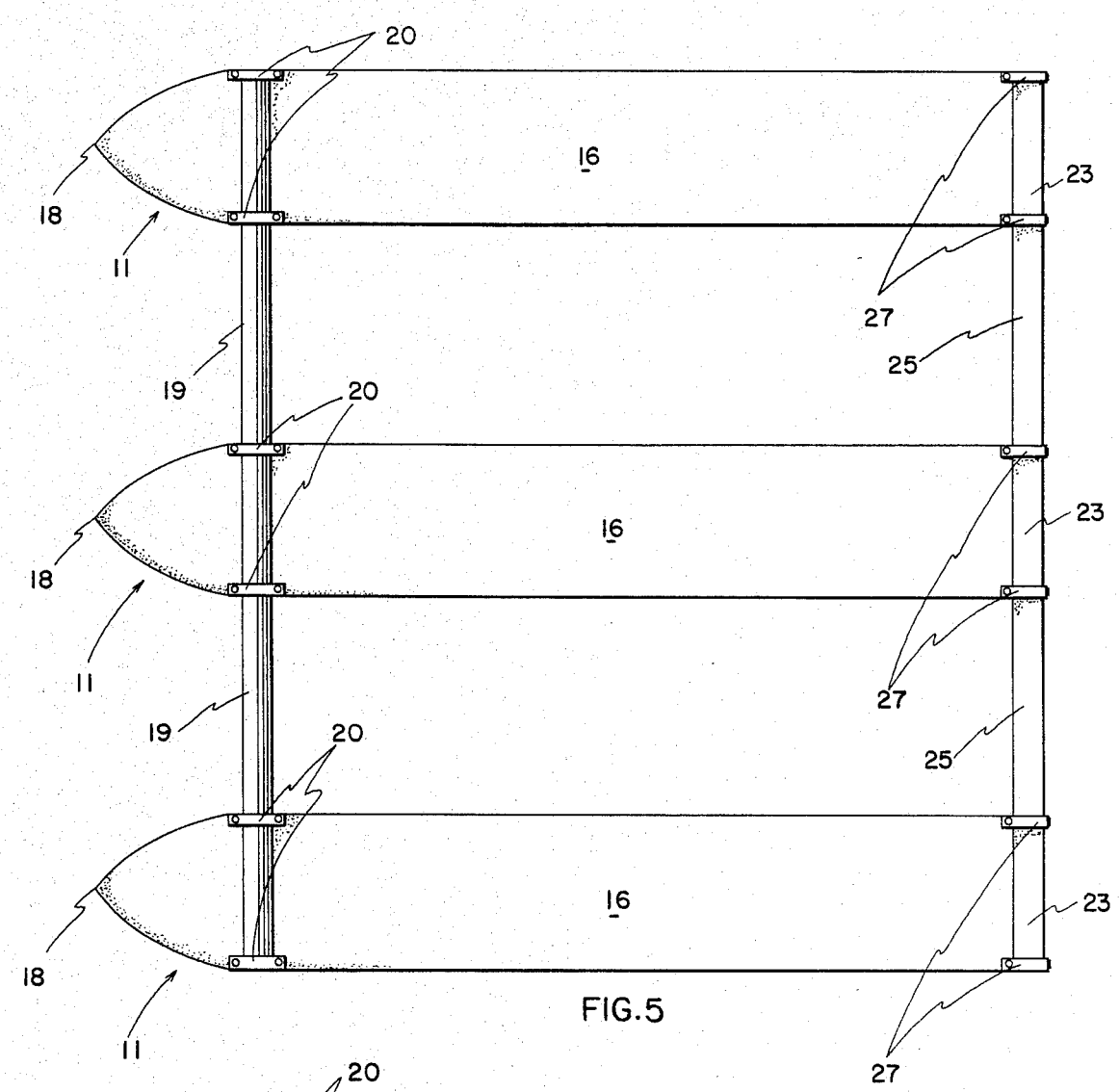
FIG. 5 is a top plan view of the floats of the present invention used in conjunction with a plurality of propulsion units.

If multiple propulsion units are to be used, additional hull means 11 can be provided as shown in FIG. 5. It is to be understood, of course, that although only three hulls and two spaces for power units are shown in such Figure, even larger numbers of floats and respective propulsion units can be used by simply extending the pivot pipes and box beams to accommodate the same.

Next a propulsion unit or module 12 is placed between two of the hulls or pontoons 16 so that frame blocks 45 and 46 rest on hull interconnecting beam 25 at the stern of the vessel. Main frames 30 and 31 will be disposed adjacent pivot pipe 19 with push knees 36 and 37 resting on such pipe. Next U-bolts 43 are placed about pivot pipe 19 and passed up through their respective push knee extensions and secured in place by nuts 44.

Once the propulsion module has been installed between the pontoon type hulls, the lower end of each of the hydraulic tilt means 78 will rest one of the tilt jack pads 29. The engine 50 can be then started and when the transmission 50' is engaged, power will be transmitted through the V-drive 53 to propeller 66 to move the tug vessel to its operating station. The large, counterbalanced rudder 67, together with the oversized propeller 66, gives good control to the vessel 10.

Figure 3:
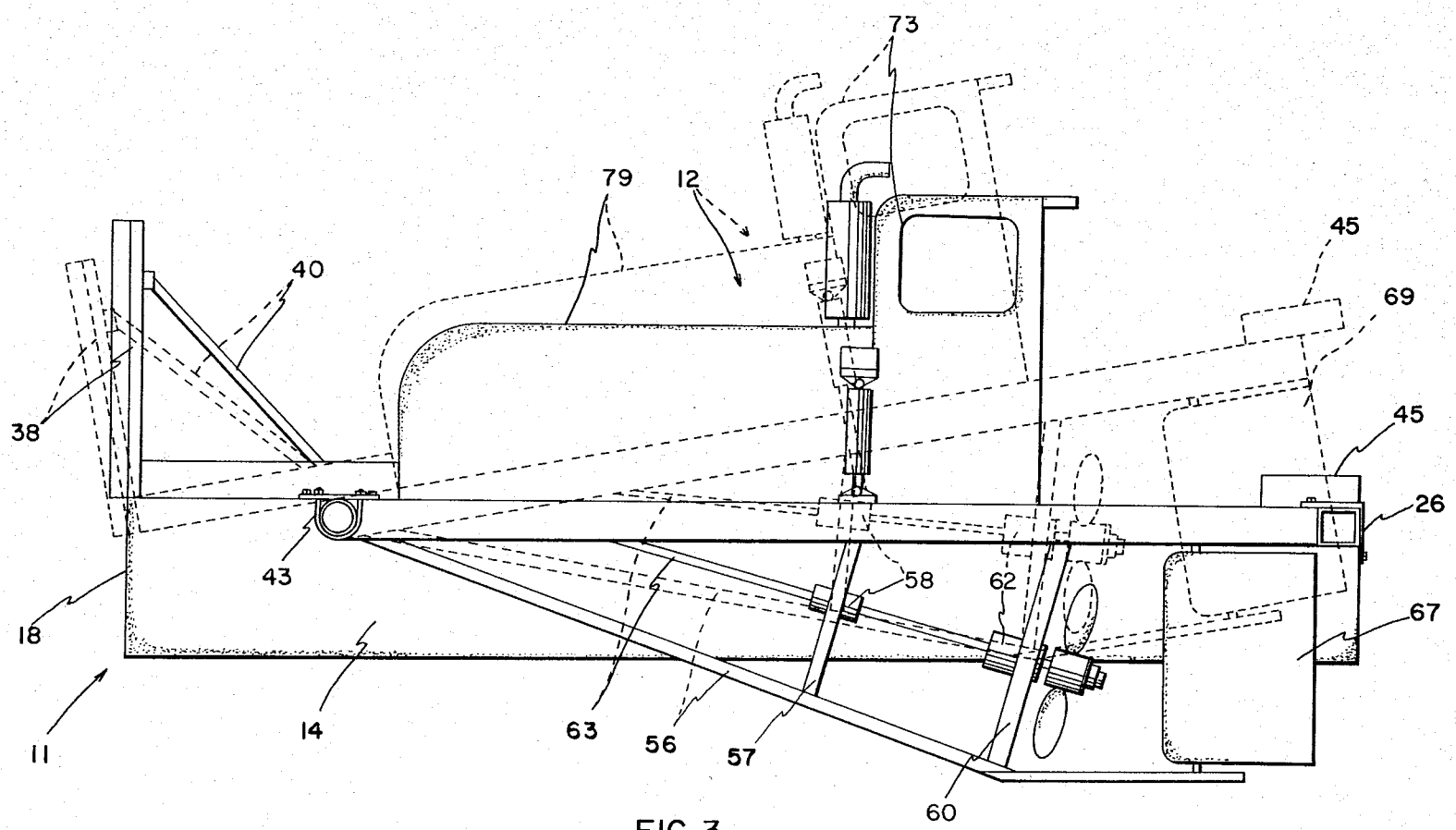
FIG. 3 is the same sectional view as shown in FIG. 2 showing the raised and lowered positions of the propulsion unit.

Should shoal waters be encountered, tilt jacks 78 can be activated in the normal manner of such devices to increase the distance between the jack pads 29 and lift beam 77 thus pivoting the entire propulsion module about pivot pipe 19 from the position shown in solid lines to the position shown in dotted lines in FIG. 3. Once the shoal has been passed, then the tilt jacks 78 can again be activated to lower the propulsion module back to the position shown in solid lines in FIG. 3 or to any desired portion therebetween.

The push knee braces 40 can be adjusted in length so that the push knees 38 can parallelly engage the barge or other vessel being maneuvered and such parallel relationship can be maintained even during shallow draft operation as described above.

When the need for the tug has been completed and it is desired to move it to another location, the above set forth assembly process is reversed and the disassembled parts can readily be loaded onto a truck type vehicle for transport to the next job site or location needing the tug.

The specific advantages in using the pontoon type hulls and propulsion unit of the present invention become more obvious when it is understood that larger tugs in excess of 26 feet overall length require Coast Guard licensed operators, are extreme draft, are very expensive to manufacture, and cannot be readily moved from place to place.

Monohull tug vessels of less than 26 feet overall length normally weigh in the neighborhood of 20 tons and are generally restricted to the use of 30 to 32 inch diameter propellers which develop approximately 3000# bollard pull using a maximum of 150 to 180 horsepower. These smaller conventional tugs generally draw at least 4 to 4½ feet of water thereby even further restricting their use. The efficiency of these vessels is between 28 and 32 percent.

The present invention on the other hand is not limited in power output due to the length of the vessel nor does it have the disadvantages of severe draft limitations. The present tug type vessel of approximately 25 feet length overall will draw only two and one-half feet of water, can efficiently utilizes a 250 horsepower engine which is easily serviced by being in the open rather than in the hole of the ship, and can use up to a five-foot diameter propeller which can develop 4500# bollard pull in deep water and yet can also operate in shallow water. The efficiency of the vessel of the present invention has been calculated to be approximately 40 percent versus the 28 percent of the conventional monohull tug.

The vessel of the present invention can be readily disassembled and trucked to a new use location because of its modular construction and can be easily and readily be maneuvered even in cross wind and cross current conditions due to its large, counterbalanced rudder. When additional power is required, additional pontoon hulls and propulsion modules can be added to accomplish the desired results.

Although the propulsion system of the present invention has been shown as an engine drive propeller shaft to turn the propeller, it is to be understood that a hydraulic or similar drive could be substituted therefor to accomplish the same results.

In summary the present invention has the advantage of providing a relatively inexpensive to produce and maintain tug type vessel which has greater bollard pull power and yet much shallower draft than previous tugs of the same general overall length.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A tug type vessel comprising: at least two spaced water supported float means; a propulsion means including an engine, a transmission, a V-drive, a propeller, and a rudder operatively associated with each other to form an integral unit pivotably mounted between said float means; a pilot house means operatively mounted on said propulsion means; hydraulic means for pivoting said propulsion means and its pilot house relative to said float means; and tug type push knee means forwardly extending from said propulsion means whereby a variable draft tug type vessel is provided.

2. A tug type vessel of claim 1 wherein a means is provided for pivotably mounting said propulsion means relative to said float means, said mounting means being a pivot pipe means extending between said float means and at least partially supporting said propulsion means.

3. The tug type vessel of claim 1 wherein said rudder is of the counterbalanced type.

4. The tug type vessel of claim 1 wherein said float means are interconnected fore and aft by cross members with said propulsion means being supported thereby.

5. The tug type vessel of claim 1 wherein said float and propulsion means are readily assembleable and disassembleable for easy transportation from one work location to another.

6. The tug type vessel of claim 1 wherein said float means are a catamaran type means.

* * * * *